United States Patent [19]

Grable

[11] 4,003,773

[45] Jan. 18, 1977

[54] METHOD OF PREPARING GRAPHITE FIBERS OF ULTRA-SHORT LENGTH AND NARROW SIZE DISTRIBUTION

[75] Inventor: Michael Anthony Grable, Frostburg, Md.

[73] Assignee: Hercules Incorporated, Wilmington, Del.

[22] Filed: Mar. 2, 1976

[21] Appl. No.: 663,164

[52] U.S. Cl. ..... 156/155; 156/180; 156/250; 83/14; 83/15; 19/66 T; 427/289; 427/434 D; 264/143; 264/136

[51] Int. Cl.[2] ..... B26D 7/08; B02C 23/00

[58] Field of Search ..... 156/155, 180, 250; 83/14, 15, 22; 19/66 T; 427/289, 434 D; 264/136, 140, 141, 143; 225/4, 103

[56] References Cited

UNITED STATES PATENTS

| | | | |
|---|---|---|---|
| 2,516,559 | 7/1950 | Fuhrhop et al. | 156/72 |
| 3,549,734 | 12/1970 | Yasuda et al. | 264/143 |
| 3,632,366 | 1/1972 | Hiraga | 264/143 |
| 3,634,570 | 1/1972 | Himelreich et al. | 264/143 |
| 3,921,874 | 11/1975 | Spain | 264/143 |
| 3,940,464 | 2/1976 | Davis | 264/136 |

*Primary Examiner*—Douglas J. Drummond
*Assistant Examiner*—M. Ball
*Attorney, Agent, or Firm*—Michael B. Keehan; Clinton F. Miller

[57] ABSTRACT

A process for cutting a multi-filament tow into fibers of ultra-short length and narrow size distribution is provided. Initially, a multi-filament tow is passed through a bath of liquid impregnating material at elevated temperature. The impregnated tow is then passed through a die which is sized to control the quantity of material impregnating the tow and to compact the filaments of the tow into a closely packed bundle. The resulting tow is then cooled to solidify the impregnating material and to convert the tow to a rigid form. The rigid tow is then cut, yielding wafer-thin disks. The impregnating material is then stripped from the wafer-thin disks with a solvent followed by removal of the solvent, thereby yielding fibers of ultra-short length and narrow size distribution.

8 Claims, 2 Drawing Figures

METHOD OF PREPARING GRAPHITE FIBERS OF ULTRA-SHORT LENGTH AND NARROW SIZE DISTRIBUTION

This invention relates to a cutting method for producing fibers of ultra-short length and narrow size distribution. It relates especially to a cutting method for producing graphite fibers having such characteristics. Graphite fibers cut according to the method of this invention are useful as burning rate augmentors in solid propellants.

The successful use of graphite fibers as burning rate augmentors in slurry cast propellants requires randomized fiber dispersion in the finished propellant. Even a small degree of systematic orientation produces anomalous burning characteristics in the finished propellant. To achieve random dispersion of the fibers in the propellant matrix, it has been found necessary, inter alia, to employ graphite fibers having ultra-short fiber lengths in the range of 0.003 to 0.005 inch (75 to 125 microns) within a narrow length distribution. Thus, the successful use of graphite fibers as burning rate augmentors in slurry cast propellants is highly dependent on the ability to produce such fibers.

The prior art of cutting short length fibers consisted of using a rotary chopper (the current state-of-the-art fiber cutting method) which produced fiber lengths of approximately 0.125 inch. This is far in excess of the 0.003 – 0.005 inch lengths required to achieve the randomized dispersion stated above. The resulting anomalous burning characteristics obtained with fibers cut by a rotary chopper, which systematically orient during propellant casting, renders the propellant unusable for the intended applications.

It is an object of the present invention to provide a method of preparing fibers of ultra-short lengths within a narrow length distribution.

A further object is to provide a method for preparing fibers with lengths between 75 and 125 microns from continuous filaments.

Further objects will become obvious in view of the following description of the invention.

The invention is a process for producing fibers of ultra-short length and narrow size distribution. In the inventive process, initially, a multi-filament tow is passed through a bath of liquid impregnating material at elevated temperature. The impregnated tow is then passed through a die, which is sized to control the quantity of material impregnating the tow and to compact the filaments of the tow into a closely packed bundle. The resulting tow is then cooled to solidify the impregnating material and to convert the tow to a rigid form. The rigid tow is then cut, yielding wafer-thin disks. The impregnating material is then stripped from the wafer-thin disks with a solvent followed by removal of the solvent, thereby yielding fibers of ultra-short length and narrow size distribution.

Figure 1:
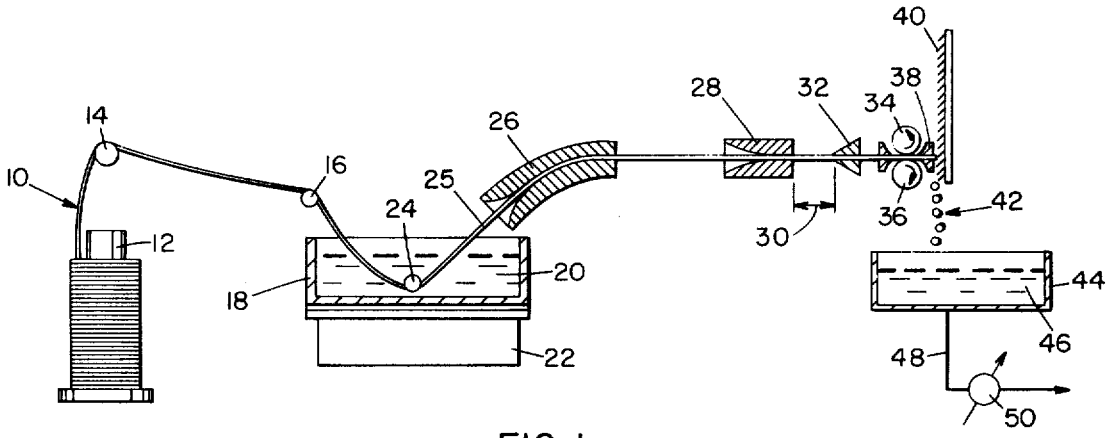
FIG. 1 is a schematic view of the preferred embodiment of the process of the invention with apparatus useful therewith.

In FIG. 1, a multi-filament tow 10 is illustrated being drawn from a stock bobbin 12 over guide rolls 14 and 16. The guide roll 16 is positioned over a reservoir 18, containing a liquid impregnating composition 20 and having heater 22, such that the multi-filament tow 10 can be drawn into a heated impregnating composition 20. The impregnating composition 20 in the preferred embodiment of this invention consists of paraffin wax heated to a temperature between 180° and 200° F. and maintained in a liquid state at said temperature by heater 22.

Direction changing roll 24 allows the multi-filament tow 10 to be drawn out of the reservoir 18 after impregnation. The impregnated tow 25 is then passed through dies 26 and 28 where the tow 25 is formed into a closely packed bundle. Die 26 also controls the amount of material impregnating the tow, allowing any excess wax to fall back into reservoir 18. In this preferred embodiment of the invention, dies 26 and 28 have tapered cylindrical shapes wherein the discharge orifice of die 28 is less restrictive than the discharge orifice of die 26. The impregnated tow 25 is then cooled in forced air cooling zone 30 to solidify the impregnating material and convert the impregnated tow to a rigid form. The rigid impregnated tow 25 is then drawn through die 32 which removes any residual hardened wax protrusions. Counter-rotating feed rolls 34 and 36 are provided in adjacent relationship defining a nip therebetween for gripping the rigid tow 25 extending from die 32 and for advancing the rigid tow 25 toward and into a circular cutting machine feeding die 38 and toward cutting head 40. Cutting head 40 preferably consists of a plurality of blades which move in a plane perpendicular to the direction of the advancing rigid tow 25, thereby chopping the rigid tow 25 into a plurality of wafer-thin disks 42. The movement of cutting head 40 is synchronized with the rate of advance of the two controlled by feed rolls 34 and 36 such that a predetermined wafer thickness can be obtained. The wafer-thin disks 42 then fall into container 44 which contains stripping solvent 46. Solvent 46 strips the hardened wax from the wafer-thin disks 42, thereby releasing fibers 48. After removal of residual solvent, the fibers are dried in forced air heating zone 50.

The invention is particularly useful for producing graphite fibers of ultra-short length and narrow size distribution from a continuous graphite filament tow. However, it should be recognized that the invention is not so limited. Thus, from a compositional standpoint, any filamentary material of natural, synthetic or metallic origin which is non-rigid at ambient conditions can be used in carrying out the invention. Examples of suitable filamentary material of natural origin are cellulose fibers such as rayon, sisal, jute and cotton and other natural fibers such as asbestos. Examples of suitable filamentary material of synthetic origin are polyamides, polyesters, acrylics, polyolefins, glass, boron, boron carbide, boron nitride, aluminum silicate and fused silica. An example of a suitable filamentary material of metallic origin is steel.

As to the form in which the filamentary material is used, it is preferred to use the material in the form of a tow consisting of continuous filaments. The aforementioned materials of synthetic origin can be readily made in continuous filament form and it is in this form that they are preferably used. The filamentary materials of natural origin generally exist only in the fibrous or fiber form. Such materials, however, can be formed into continuous threads or yarns. A plurality of such threads or yarns can be assembled into a tow and subjected to the cutting process of this invention. Such assembly or tow will of course be continuous, and it should for present purposes have sufficient strength to withstand the tension accompanying movement from its source through apparatus associated with the process of this invention. It will be appreciated that tow can be made from filamentary material of synthetic origin starting from staple fiber in a similar manner. For the purposes of this invention, it will be understood that the term "multi-filament tow" comprises both a tow consisting of continuous filaments and a tow which is an assembly of continuous threads or yarns formed in the manner above described.

While the invention has been described above in terms of heated paraffin wax as the impregnating material, it should be recognized that it is not thus limited. Any material may be employed for this purpose which is solid at ambient temperature, can be converted to the liquid state by the application of heat, and can be removed from the wafer thin disks relatively easily without damaging the fibers. Therefore, a material that can be easily dissolved by a solvent is preferred. A relatively wide range of impregnating materials can be used. Specific examples of applicable impregnating materials are waxes, polyvinyl chloride, polyvinyl alcohol, linear polyethylene, polyurethane prepolymer, polystyrene, and cellulose acetate.

A stripping solvent is employed to remove the impregnating composition from the cut fibers. Choice of a stripping solvent will depend on the impregnating composition. The stripping solvent must be a solvent for the impregnating composition and a non-solvent for the fiber being cut in accordance with the process of this invention. The stripping solvent is preferably a relatively volatile solvent such that it can be removed by forced air drying at temperatures of about 60° C.

The stripping solvent 46, which is used to remove the hardened paraffin wax from the wafer thin disks 42, in the preferred embodiment of this invention is Varsol. Varsol is an aliphatic hydrocarbon solvent having a boiling point between 145° and 200° C., produced by the straight-run distillation of petroleum.

In the preferred embodiment of this invention, coating die 26 is sized to form a constrictive cylindrical duct around the molten wax soaked tow in such a way as to apply a "squeege" action to limit the amount of wax to that amount necessary for satisfactory impregnation of the tow. Die 26, in addition to controlling the amount of material impregnating the tow, also removes entrapped air from the tow. Entrapped air has a detrimental effect on the supportive efficiency of the impregnating material. Passage of the impregnated tow through die 28, which has a less restrictive discharge orifice than die 26, assures a more uniform cylindrical shape.

When the waxed tow 25 emerges from the coating die 26, the wax is in a molten stage and cools to a semi-solid state before entering forming die 28, which shapes the impregnated tow into a more uniform cylindrical shape and smooths the surface of the two. However, any residual hardened wax protrusions existing along the surface of the tow after its passage through die 28 can impede movement of the tow. These protrusions along the surface of the rigid impregnated tow 25 can result from broken or matted fibers which occasionally occur during production of the tow or in transfer of the tow from stock bobbin 12. These protrusions pass through die 26 without conforming to the cylindrical bundle geometry due to their resilient nature. Upon cooling, after passage through forced air cooling zone 30, the protrusions must be removed. The trimming die 32 acts as a circular knife which trims off these protrusions, thereby preparing the tow for passage through circular cutting machine feeding die 38 without jamming or otherwise having movement of the tow impeded. Any condition that slows or otherwise impedes the movement of the rigid tow 25 through die 38 would increase the production of fines in the final product thereby causing a wider distribution of fiber lengths than desired.

The McKiernan-Terry small arms cutting machine is a suitable cutting machine available for cutting impregnated tow for the production of ultra-short fibers. However, a more simplified version of this cutting machine employing the same cutting method could be constructed for fiber cutting. The essential elements of such a machine are gear driven feed rolls synchronized with a cutting head, and cutting die assembly.

The primary advantage of this invention is that it provides a new capability for producing fibers of ultra-short length and narrow size distribution which is not feasible when using existing cutting methods. This invention is also very versatile in that a wide range of fiber lengths can be produced by varying the speed of the feed rolls in the cutting operation. Another advantage of the invention is that various high modulus type materials of a brittle nature can be adequately supported and precisely cut to form fibers of ultra-short length and narrow size distribution for specific applications such as burning rate augmentors in rocket propellants.

The process of this invention is useful for preparation of ultra-short filaments for use in any filled polymer system whose properties would benefit from the incorporation of short filament materials of uniform length distribution, for example, the improvement of isotropic mechanical properties.

The following examples will serve to illustrate further the present invention and its practice, but are not to be construed as being limitations thereon. All percentage figures are by weight unless otherwise indicated.

EXAMPLE 1

A high modulus type graphite tow composed of about 10.000 continuous filaments, each filament having a diameter between about 4 microns and about 10 microns, was passed through a paraffin wax impregnating material to form a 0.065 inch diameter semi-solid bundle using the process and equipment illustrated in FIG. 1. The paraffin was heated and maintained at a temperature between 180° and 200° F. through which the graphite tow was passed at a rate of 25 ft./min. After exit from the bath, the resulting wax-impregnated tow was passed through a 0.062 in. diameter tapered cylindrical die to remove excess wax and entrapped air, thence through a 0.065 in. tapered cylindrical forming die in a semi-solid state to form a cylindrical bundle. This impregnated tow was then passed through a forced air cooling zone, thence through a final trimming die having a cutting edge aligned to trim off malformations such as hardened wax or fiber protrusions. The rigid impregnated tow was passed through an 0.086 inch circular cutting machine feeding die and two rubber feed rolls controlled at a synchronized speed so as to advance the tow toward the cutting head of a McKiernan-Terry small arms cutting machine at a rate that cuts the tow into wafer-thin disks having an average thickness of 100 microns (0.004).

The wafer-thin disks were then dewaxed to release the ultra-short graphite fibers. In the dewaxing step, initially, the disks were contacted with Varsol, a petroleum aliphatic solvent (a mixture having a boiling range of from about 145°–200° C.), followed by agitation with a stirrer to break up agglomerates. The resulting mixture of wax, solvent and fiber was then placed in a Buchner funnel, which was mounted on a vacuum filtering flask. Vacuum was applied to the filtering flask to expedite the separation of the wax-laden solvent from the ultra-short graphite fibers. The fiber cake remaining in the funnel was then flushed with additional solvent. This step was followed by a final flush with pentane, at ambient temperature, to remove the residual solvent from the fiber cake. Pentane, which has a lower boiling point than the Varsol and is miscible therein, quickly removed the slower drying Varsol which in turn reduced processing time.

The length of the fibers obtained by the process of this invention can be determined by a microscopic measuring method. In carrying out this method, the number of graphite fibers having lengths falling within 10 micron length categories of increasing length (0–10, 10–20, 20–30, etc. ) is determined microscopically. From these data, a plot is constructed showing the cumulative fiber length frequency occurring in the sample. Using the resulting curve, the average fiber length of the sample can be determined by reading the fiber length which corresponds to 50% cumulative fiber length frequency. The curve also shows the fiber length range from minimum to maximum as well as giving a comparative measure of the fines.

Figure 2:
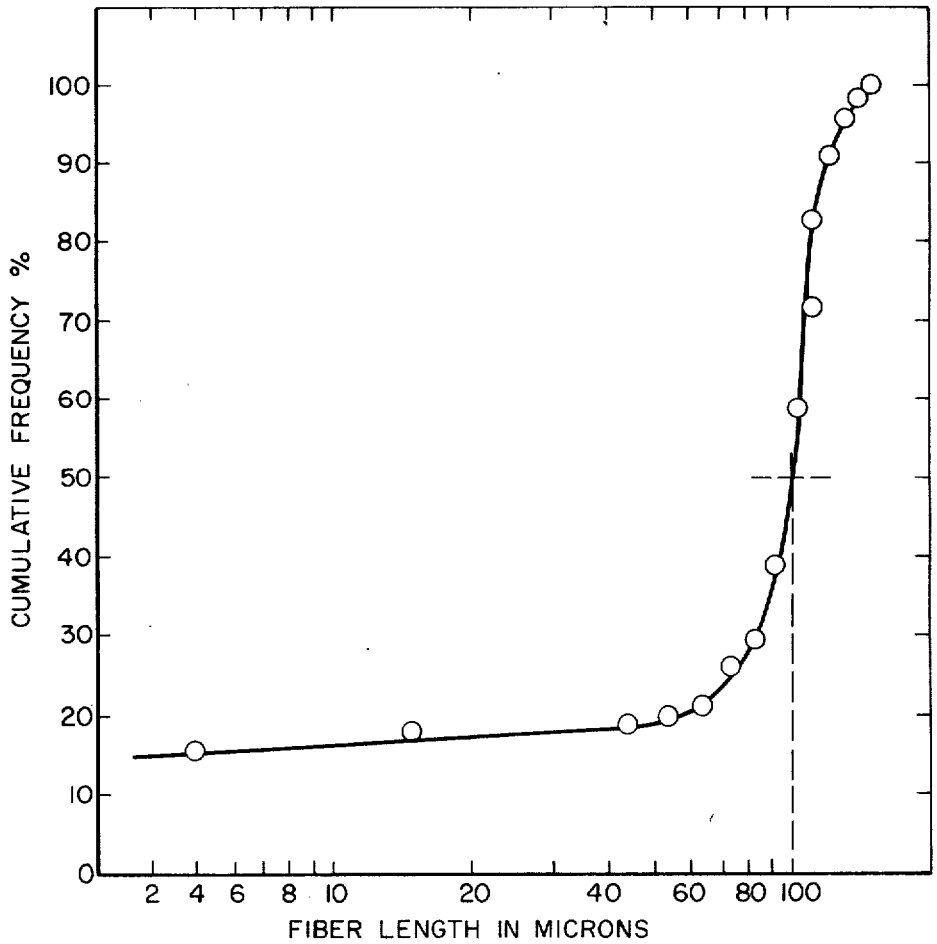
FIG. 2 shows a typical cumulative fiber length frequency plot of ultra-short fibers of narrow size distribution made in accordance with the process of this invention.

The fibers of Example 1 were subjected to this microscopic measuring method and a plot of cumulative fiber length frequency was made. The cumulative fiber length frequency curve presented in FIG. 2 shows the cumulative fiber length frequency occurring in the samples. At the 50% cumulative fiber length frequency level, the average fiber length is 100 microns.

The fibers of Example 1 were randomly distributed in a composite propellant formulation at the 3% level as shown in Table 1. A base composition, which did not contain graphite fiber, was prepared as a control sample. Burning rates for each of the propellant samples were obtained by burning a 3 inch long, ¼ inch square strand, burned under a pressure of 2000 p.s.i. in a closed vessel. The burning rate for the base composition was 8.35 in./sec., while the burning rate for the strand prepared from the composition which contained graphite fiber was 14.8 in./sec. These comparative burning rate values for the two compositions shown in Table 1 illustrate a burning rate augmentation of 77.4% for the propellant containing the graphite fibers prepared by the process of this invention.

Table I

| Ingredients | Composition (%) |
|---|---|
| Binder Composition | 14.00 |
| Aluminum (90μ)* | 10.00 |
| Ammonium Perchlorate (200μ)* | 30.00 |
| Ammonium Perchlorate (90μ)* | 8.00 |
| Ultrafine Ammonium Perchlorate (0.5μ)* | 35.00 |
| Graphite Fibers (100μ) | 3.00 |
| Base Rate** (in./sec.) | 8.35 |
| Augmented Rate (in./sec.) | 14.81 |

Table I-continued

| Ingredients | Composition (%) |
|---|---|
| Rate Augmentation (%) | 77.4 |

*Average particle size, weight basis.
**"Base Rate" refers to the burning rate of a composition having all of the ingredients above in the same relative protions, but without the inclusion of any graphite fibers.

The "binder composition" used in this example as well as the binder composition used in Examples 2 and 3 is one in which hydroxyterminated polybutadiene rubber was incorporated as the binder ingredient. The exact formulation of the binder composition is proprietary in nature. However, for the purpose of demonstrating the utility of fibers prepared in accordance with this invention for substantially augmenting the burning rate of composite propellants, the formulations of the binder composition is not critical. Any binder composition known to the art to be suitable for making composite propellants may be used, as for example, the following:

| Ingredients | % |
|---|---|
| Hydroxyterminated Polybutadiene Rubber | 38.64 |
| Triethylamine | 0.71 |
| Isocyanatomethyltrimethylcyclohexylisocyanate | 5.00 |
| Antioxidants | 1.00 |
| Isodecyl Pelargonate | 54.29 |
| Triphenyl Bismuth | 0.36 |
| | 100.00 |

EXAMPLE 2

The method of Example 1 was repeated using a different propellant composition and the same lot of graphite fiber two, except that the rigid tow was cut such that fibers having an average length of 90 microns were formed. The fibers were then randsmly distributed in a composite propellant formulation at the 3% level and burned under 2000 p.s.i. pressure to obtain a burning rate value, which is shown in Table II. The burning rate augmentation for this example was 77.3% over that obtained with a base propellant formulation which did not contain fibers.

Table II

| Ingredients | Composition (%) |
|---|---|
| Binder Composition | 15.52 |
| Aluminum (90μ)* | 9.70 |
| Ammonium Perchlorate (200μ)* | 33.95 |
| Ammonium Perchlorate (90μ)* | 8.73 |
| Ultrafine Ammonium Perchlorate (0.5μ)* | 29.10 |
| Graphite Fibers (90μ) | 3.00 |
| Base Rate** (in./sec.) | 4.85 |
| Augmented Rate (in./sec.) | 8.60 |
| Rate Augmentation (%) | 77.3 |

*Average particle size, weight basis
**"Base Rate" refers to the burning rate of a composition having all of the ingredients above in the same relative proportions, but without the inclusion of any graphite fibers.

EXAMPLE 3

The method used in Example 1 was repeated using a different propellant composition and the same lot of graphite fiber tow, except that the rigid tow was cut such that fibers having an average length of 76 microns were formed. The fibers were then randomly distributed in a composite propellant formulation at the 3% level and burned under 2000 p.s.i. pressure to obtain a burning rate value, which is shown in Table III. The burning rate augmentation for this example was 65.7% over that obtained with a base propellant formulation which did not contain fibers.

Table III

| Ingredients | Composition (%) |
|---|---|
| Binder Composition | 15.52 |
| Aluminum (90μ)* | 9.70 |
| Ammonium Perchlorate (200μ)* | 24.25 |
| Ammonium Perchlorate (90μ)* | 14.55 |
| Ammonium Perchlorate (5.0μ)* | 13.58 |
| Ultrafine Ammonium Perchlorate (0.5μ)* | 19.40 |
| Graphite Fibers (76μ) | 3.00 |
| Base Rate** (in./sec.) | 3.94 |
| Augmented Rate (in./sec.) | 6.53 |
| Rate Augmentation (%) | 65.7 |

*Average particle size, weight basis

**"Base Rate" refers to the burning rate of a composition having all of the ingredients above in the same relative proportions, but without the inclusion of any graphite fibers.

As will be evident to those skilled in the art, various modifications can be made in the light of the foregoing disclosure and discussion, without departing from the spirit or scope of the disclosure or from the scope of the claims.

What I claim and desire to protect by Letters Patent is:

1. A method for preparing fibers of ultra-short length and narrow size distribution from multi-filament tow comprising the steps of:
   a. providing a source of multi-filament tow;
   b. passing said multi-filament tow through a bath of liquid impregnating material at elevated temperature, said impregnating material being one which is solid at ambient temperature;
   c. passing said impregnated tow through a die sized to control the quantity of material impregnating the tow and to compact the filaments of the tow into a closely packed bundle;
   d. cooling the compact tow to solidify the impregnating material therein and to convert the tow to a rigid form;
   e. cutting said rigid tow to produce wafer-thin disks therefrom;
   f. stripping the impregnating material from said wafer-thin disks with a solvent to yield fibers of ultra-short length and narrow size distribution; and
   g. removing solvent from the fibers.

2. A method according to claim 1 wherein the multi-filament tow consists of graphite filaments.

3. A method according to claim 1, wherein said multi-filament tow is passed through a bath containing heated paraffin wax.

4. A method according to claim 1, including the following additional step:
   passing the rigid tow of step (d) through a die, after cooling, whereby high spots or other malformations are removed.

5. A method according to claim 1, including the following additional step:
   passing the impregnated tow of step (c) through a second die, said second die having a discharge orifice larger than the discharge orifice of the die at step (c), to further shape the impregnated tow.

6. A method according to claim 1 wherein the impregnated tow of step (b) is passed through a cylindrical die sized to control the quantity of material impregnating the tow and to compact the filaments of the tow into a closely packed bundle.

7. A method according to claim 5, including the following additional step:
   passing the rigid tow of step (d) through a die, said die having a trimming edge whereby protrusions along the surface of the rigid tow are removed.

8. A method according to claim 7 wherein the multi-filament tow consists of graphite filaments and said multi-filament tow is passed through a bath containing heated paraffin wax.

* * * * *